US005976216A

United States Patent [19]

Samal et al.

[11] Patent Number: 5,976,216

[45] **Date of Patent: *Nov. 2, 1999**

[54] NICKEL-CONTAINING STRENGTHENED SINTERED FERRITIC STAINLESS STEELS

[75] Inventors: Prasan K. Samal; Erhard Klar, both of Raleigh, N.C.

[73] Assignee: OMG Americas, Inc., Cleveland, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,262

[22] Filed: Feb. 24, 1997

Related U.S. Application Data

[60] Provisional application No. 60/023,059, Aug. 2, 1996.

[51] Int. Cl.[6] ..... C22C 33/00

[52] U.S. Cl. ..... 75/255; 75/246; 75/331; 419/38

[58] Field of Search ..... 75/246, 255, 331; 419/38

[56] References Cited

U.S. PATENT DOCUMENTS

| | | | |
|---|---|---|---|
| 4,049,429 | 9/1977 | Donachie | 75/246 |
| 4,139,377 | 2/1979 | Bergh et al. | 75/243 |
| 4,552,719 | 11/1985 | Morimoto et al. | 419/2 |
| 4,662,939 | 5/1987 | Reinshagen | 75/246 |
| 5,529,604 | 6/1996 | Reinshagen | 75/246 |
| 5,629,091 | 5/1997 | Rao et al. | 428/403 |

*Primary Examiner*—Ngoclan Mai
*Attorney, Agent, or Firm*—Kalow Springut & Bressler LLP

[57] ABSTRACT

Powder metallurgically produced ferritic stainless steel articles are strengthened by alloying the ferritic material with a small amount of nickel (up to 3.0% by weight). Alloying is carried out by either admixing nickel powder to the ferritic alloy powder or by pre-alloying the stainless steel powder with nickel. Conventional sintering procedures, either in a hydrogen atmosphere or in a partial vacuum, are applicable. High strength stainless steel parts made in this manner are suitable for demanding applications, including automotive exhaust flanges and HEGO bosses.

13 Claims, No Drawings

NICKEL-CONTAINING STRENGTHENED SINTERED FERRITIC STAINLESS STEELS

This application claims priority of U.S. Provisional patent application No. 60/023,059, filed Aug. 2, 1996, the contents of which are hereby incorporated by reference into the present disclosure.

BACKGROUND OF THE INVENTION

The present invention relates to the strengthening of sintered ferritic stainless steels. Such steels are useful in demanding automotive applications such as flanges for exhaust systems.

Powder metallurgy (P/M parts are made by pressing metal (or alloy) powders into a compact, followed by sintering the compact at a high temperature in a protective atmosphere. P/M stainless steel parts are commonly made by using pre-alloyed powders of the desired composition. Water-atomized pre-alloyed, minus 100 mesh powders are typically used, since these offer good green strength and compressibility and are cost effective. Although fully pre-alloyed powders are commonly used, the powder metallurgy process is amenable to the use of additives for the enhancement of properties of the sintered parts. The high sintering temperatures (above ca. 2000° F.) and long sintering times (>20 minutes) employed are in most instances sufficient for substantial diffusion and alloying of the additive metal in the matrix alloy.

P/M stainless steel parts offer cost advantages over their wrought counterparts, while maintaining the requisite mechanical strength, corrosion resistance, oxidation resistance and elevated strength. The P/M process is quite flexible and allows enhancement of one or more critical properties for a given application by making only minor modifications in the alloy composition, use of additives and/or changes in processing parameters.

In some applications, however, the strength of P/M stainless steel parts may not be sufficient. Specific examples are the flanges used in automobile exhaust systems. These flanges are either welded or bolted onto the engine or onto other components of the exhaust system. Important properties for such flanges include corrosion resistance, oxidation resistance, mechanical strength and impact resistance, at both ambient and elevated temperatures. High strength is essential for maintaining the leak-tightness of the flange-to-flange and flange-to-manifold bolted joints, so that the exhaust gases do not leak out of the exhaust system prior to entering the catalytic converter. Wrought stainless steel flanges perform satisfactorily, in general; however, the geometry and sizes of these flanges are such that the P/M process would be significantly less costly. The P/M process also offers more flexibility with the design of the flanges, permitting the selection of the optimum design for the best performance and weight control for specific locations and various automobile models.

Ferritic grades of stainless steels are almost always used in automobile exhaust systems for flanges, pipes, HEGO (Hot Exhaust Gas Oxygen Analyzer) bosses and other components. These grades of stainless steel are cost effective and offer adequate corrosion resistance, oxidation resistance and mechanical strength.

Ferritic stainless steels, however, are generally not heat treated because they do not undergo phase transformations that increase strength and hardness after heating and fast cooling. (Martensitic alloys, on the other band, can be hardened by heat treatment.) If an application, therefore, requires sintered ferritic stainless steels of higher strength, such added strength is usually achieved by increasing the sintered density or increasing the alloy content. For example, the commonly used ferritic P/M stainless steels are AISI types 409L, 410L, 430L and 434L; the strength increase associated with the change from the low alloyed 409L to the higher alloyed 434L is in the range of about 10 to 15 percent when expressed in terms of ultimate tensile strength (UTS). In some instances, such an increase may not be sufficient and, additionally, the higher alloyed grades cost more.

P/M stainless steels may also be sintered in an atmosphere of dissociated ammonia, in which case the steels absorb substantial amounts of nitrogen which provide significant solid solution strengthening. Without rapid cooling after sintering, however, corrosion resistance will be drastically reduced due to sensitization. Acceptable cooling rates are several hundred degrees C per minute, which are not commercially feasible at the present state of the art of sintering. Thus, this method of strengthening is generally not practiced when corrosion resistance is important.

In the area of wrought ferritic stainless steels, U.S. Pat. No. 2,210,341 discloses a nickel addition of 0.3 to 3% to welding rods containing from 8 to 15% Cr, 0.3 to 3% Mn, 0.3 to 3% Mo and 0.02 to 0.07% carbon, with the balance iron. The addition of nickel promotes a fine grain structure and makes the welds tough and ductile. Some of the more recent wrought ferritic stainless steels contain small amounts of nickel because of its beneficial effect on toughness, on lowering the ductile-to-brittle transition temperature, and on improving their passivity characteristics. P/M stainless steels do not undergo grain growth as the wrought stainless steels do, and hence do not require nickel addition to control grain structure. Even with the wrought ferritic stainless steels, nickel addition is much less frequently practiced due to the advent of nickel containing welding wires which can provide nickel to the weld zone.

Accordingly, it is desirable to increase the strength of sintered ferritic stainless steels without requiring rapid post-sintering cooling and without reducing corrosion resistance. An object of this invention is to produce sintered ferritic stainless steel compositions having such properties. Another object is to produce sintering powders comprising ferritic stainless powders containing nickel as a pre-alloyed and/or blended powder component.

SUMMARY OF THE INVENTION

These and other objects and advantages are achieved by the present invention which is directed to metal powders comprising small but effective proportions of nickel. The amount of nickel added can range from about 0.1 to about 3 weight percent, preferably from about 0.3 to 2.0%, and more preferably from about 0.5 to about 1.5%, and is effective in increasing the mechanical strength of sintered product compared to similar sintered products lacking a nickel component. The nickel can be added to the stainless steel powders in particulate form and/or alloyed with the stainless steel itself.

DETAILED DESCRIPTION OF THE INVENTION

The above and other advantages of the invention will be apparent to those skilled in the art from a perusal of the following detailed description, examples and the appended claims.

Stainless steel is composed of primarily iron alloyed with at least 10.5% chromium. Other elements selected from silicon, nickel, manganese, molybdenum, carbon, etc., may be present in specific grades. Ferritic stainless steels are alloys of iron and chromium containing more than 10.5 weight percent chromium and having a body-centered cubic crystalline structure at room temperature. These alloys are magnetic.

Representive commercial ferritic P/M stainless steels and their contents are tabulated below according to their AISI numbers.

| Steel | Cr | Ni | Mo | Si | Mi | C | P | Fe |
|---|---|---|---|---|---|---|---|---|
| 409L | 11.5 | — | — | 0.80 | 0.16 | 0.020 | 0.012 | Bal* |
| 410L | 12.7 | — | — | 0.80 | 0.18 | 0.018 | 0.012 | Bal |
| 430L | 16.8 | — | — | 0.80 | 0.18 | 0.020 | 0.020 | Bal |
| 434L | 16.8 | — | 1.0 | 0.85 | 0.17 | 0.020 | 0.020 | Bal |

*409L also contains 0.5 wt % Nb.

The standard ferritic stainless steels do not contain any nickel, except as trace impurities of the order from bare detection to about 0.3 weight percent, typically. The austenitic stainless steels, on the other hand, typically contain about 8 to 12 weight percent nickel. The most commonly used ferritic stainless steels for automobile exhaust flanges and HEGO bosses are the above cited 409L, 410L, 434L steels and their modifications. In P/M processing, these modifications often involve increasing the contents of chromium and/or molybdenum by 1 or 2 percent. Alloy 409L contains a small amount of niobium or titanium, which improves its welding characteristics. Alloys 410L and 434L can also be alloyed with small amounts of niobium and/or titanium to improve their welding characteristics. The "L" designation refers to the low carbon content of the alloys (<0.03 wt %), which is essential for improved corrosion resistance, compressibility of the powder and weldability of the parts. Series 410L steel can be converted to a martensitic alloy by the addition of small amounts (0.2%, typically) of carbon prior to processing, which will make it responsive to heat treatment.

Stainless steel powders are used to prepare sintered parts for automotive applications and the like by forming the powders into the appropriate shapes and heating at sintering tees (typically ca 2000° F.) for a period of time effective to form a solid sintered material. The sintering powders are typically −100 mesh, having average particle sizes of ca. 60–70 microns and a maximum particle size of 149 microns. In some cases it is desirable to rapidly cool the thus formed parts after sintering to maintain corrosion resistance, but often acceptable cooling rates are too high to achieve in commercial sintering furnaces.

In accordance with the invention, it has been discovered that the incorporation of nickel into ferritic stainless steel powders, as particulate nickel and/or an alloy component of the steel particles, will increase the mechanical strength of parts sintered from such powders. The increased strength may range from about 5 to about 35 percent (as reflected by ultimate tensile strength) compared with parts made from powder materials not containing nickel.

While the invention is illustrated by examples involving specific types of commercial ferritic stainless steels, it can be practiced with any suitable ferritic stainless steel and produce similar strengthening effects.

The nickel can be introduced as an alloy component of the stainless steel powder (i.e., "pre-alloyed") in the appropriate proportions when the stainless steel is produced and prepared in powdered form. The nickel may also be added in the form of a nickel-bearing master alloy. Alternatively, or to supplement this proportion of nickel in the steel, elemental nickel or nickel compounds can be added in particulate form of particle sizes comparable to those of the steel material, and mixed or blended thoroughly. The effective amount of nickel added to the stainless steel alloy will vary somewhat with different alloys, but typically ranges from about 0.1 to about 3 weight percent, preferably from about 0.3 to about 2.0 weight percent, and most preferably from about 0.5 to about 1.5 weight percent of the final alloy.

EXAMPLES

The following examples set forth preferred embodiment of the invention. These examples are merely illustrative and are not intended to, and should not be construed to, limit the scope of the claimed invention in any way.

In order to assess the effect of nickel addition on a broad range of ferritic alloys, experiments were conducted using 409L and 434L. (It may be noted here that 410L is very similar in composition to 409L, expect that it does not contain any niobium). These experiments were conducted using both pre-alloyed powders, containing desired amounts of nickel, and regular powders admixed with nickel powder. Various nickel contents were used in the range of 0.00 to 2.00%. For the admixing approach a fine grade of nickel powder (carbonyl nickel having an average particle size of 10 microns) was used, so that substantial alloying would take place during the normal sintering practice. It is contemplated, however, that a coarser grade of nickel may also be effective, especially if the time and/or temperature of sintering are kept high. All sintering was carried out in hydrogen or in a vacuum. Sintering in a nitrogen bearing gas leads to absorption of nitrogen, which imparts high strength to the sintered part, but it drastically lowers the corrosion resistance. Sintering temperatures of about 2200° F. to about 2400° F. were used. All powders were blended with 1.0% Acrawax C solid lubricant powder to aid in compaction.

High strength in sintered parts is essential for exhaust flange applications since the flange must resist deformation during assembly (and during subsequent use) even when under high bolt torques, and must keep the joint leak free. Alternate means of increasing the mechanical strength (to a limited extent) of the flange include increasing the density of the flange or increasing its thickness. The densities of P/M stainless steel flanges are typically in the range of 6.80 to 7.30 gm/cc, and increasing the density further is not practical or cost effective. Likewise, increasing the thickness is not a desirable option due to the fact that the exhaust systems are designed with wrought flange thicknesses in mind, and an increase in weight or thickness is considered undesirable.

Comparative Example 1

Standard Transverse Rupture Test Specimens and Tensile Test specimens ("dog-bone" shape) were prepared using commercially produced 434L powder (SCM Metal Products Lot 04506524). One set of specimens was made from the as-produced (−100 mesh, water atomized) powder. Four sets of specimens were prepared using the above lot of 434L powder admixed with various amounts of nickel powder. The amount of nickel in these sets of specimens was 0.5%, 1.00%, 1.25% and 1.50% by weight, respectively. A fully pre-alloyed 434L powder containing 1.33% nickel was also included in these experiments. All specimen were compacted using standard dies, under a pressure of 50 tons per square inch. Sintering was carried out in a vacuum furnace at a tee of 2300° F., using 1000 microns of Hg of argon as the back-fill atmosphere. Sintering time period was 45 minutes. All sintered specimens were tested using standard Metal Powder Industries Federation (MPIF) procedure. The green densities, sintered densities, and the mechanical properties of all samples are shown in Tables 1(a) and 1(b).

As shown in the Tables, the yield strength ultimate tensile strength, the transverse rupture strength and the hardness increase as the nickel content is increased. The ductility as measured by tensile elongation decreases gradually but is much higher than the minimum required for most common applications. A smaller but still acceptable elongation (12 to 16%) is observed for the fully pre-alloyed specimens. In most applications, including exhaust flanges, elongations of the order of about 5.0% are sufficient. Hence, one can benefit from nickel addition to increase strength by up to 33% without any significant loss in ductility.

TABLE 1(a)

Densities and Mechanical Properties of Transverse Rupture Specimens (Comparative Example 1)

| Powder Type | Green Density, gm/cm$^3$ | Sintered Density, gm/cm$^3$ | Transverse Rupture Strength, KSI | Hardness, HRB |
|---|---|---|---|---|
| 434L | 6.42 | 7.15 | 172 | 45 |
| (Regular) | 6.43 | 7.14 | 162 | 45 |
| 434L + | 6.45 | 7.20 | 171 | 47 |
| 0.5% nickel powder (admixed) | 6.43 | 7.19 | 174 | 48 |
| 434L + | 6.44 | 7.24 | 179 | 53 |
| 1.0% nickel powder (admixed) | 6.46 | 7.22 | 178 | 52 |
| 434L + | 6.43 | 7.15 | 177 | 72 |
| 1.25% nickel powder (admixed) | 6.42 | 7.19 | 178 | 70 |
| 434L + | 6.52 | 7.23 | 176 | 74 |
| 1.33% nickel (pre-alloyed) | 6.51 | 7.23 | 181 | 77 |
| 434L + | 6.40 | 7.12 | 184 | 77 |
| 1.50% nickel powder (admixed) | 6.42 | 7.15 | 185 | 77 |

TABLE 1(b)

Densities and Mechanical Properties of Tensile Test Specimens (Comparative Example 1)

| Powder Type | Green Density, gm/cm$^3$ | Sintered Density, gm/cm$^3$ | Yield Strength KSI | Ultimate Tensile Strength KSI | Elong % |
|---|---|---|---|---|---|
| 434L | 6.35 | 7.11 | 36 | 58 | 26 |
| (Regular) | 6.36 | 7.12 | 36 | 56 | 27 |
| 434L + | 6.36 | 7.15 | 41 | 59 | 25 |
| 0.5% nickel powder (admixed) | 6.39 | 7.19 | 39 | 59 | 28 |
| 434L + | 6.36 | 7.15 | 44 | 61 | 27 |
| 1.0% nickel powder (admixed) | 6.36 | 7.16 | 44 | 62 | 28 |
| 434L + | 6.37 | 7.15 | 44 | 61 | 26 |

TABLE 1(b)-continued

Densities and Mechanical Properties of Tensile Test Specimens (Comparative Example 1)

| Powder Type | Green Density, gm/cm$^3$ | Sintered Density, gm/cm$^3$ | Yield Strength KSI | Ultimate Tensile Strength KSI | Elong % |
|---|---|---|---|---|---|
| 1.25% nickel powder (admixed) | 6.36 | 7.20 | 44 | 61 | 24 |
| 434L + | 6.52 | 7.25 | 48 | 67 | 16 |
| 1.33% nickel (pre-alloyed) | 6.52 | 7.23 | 49 | 67 | 12 |
| 434L + | 6.36 | 7.16 | 46 | 62 | 23 |
| 1.50% nickel powder (admixed) | 6.35 | 7.18 | 46 | 62 | 23 |

Comparative Example 2

Standard Transverse Rupture Test Specimens and Tensile Test specimens ("dog-bone" shape) were prepared using commercially produced 409L powder (SCM Metal Products Lot 04506618). One set of specimens was made from the as-produced (−100 mesh, water atomized) powder. Two sets of specimens were prepared using the above lot of 409L powder admixed with various amounts of nickel powder. The amount of nickel in these sets of specimens was 0.5% and 0.75% by weight, respectively. A fully pre-alloyed 409L powder containing 1.0% nickel was also included in these experiments. All specimens were compacted using standard dies, under a pressure of 50 tons per square inch. Sintering was carried out in a vacuum furnace at a temperate of 2300° F., using 1000 microns of Hg of argon as the back-fill atmosphere. Sintering time period was 45 minutes. All sintered specimens were tested using standard Metal Powder Industries Federation (MPIF) procedure. The green densities, sintered densities, and the mechanical properties of all samples are shown in Tables 2(a) and 2(b).

As shown in the Tables, the yield strength, ultimate tensile strength. the transverse rupture strength and the hardness increase as the nickel content is increased. The ductility as measured by tensile elongation decreases gradually but does not fall below 10%. In most applications, including exhaust flanges, elongations of the order of about 5.0% are sufficient. Hence, one can benefit from nickel addition to increase strength by up to 33% without any significant loss in ductility.

TABLE 2(a)

Densities and Transverse Rupture Strengths of Specimens (Comparative Example 2)

| Powder Type | Green Density, gm/cm$^3$ | Sintered Density, gm/cm$^3$ | Transverse Rupture Strength KSI | Hardness HRB |
|---|---|---|---|---|
| 409L | 6.68 | 7.28 | 177 | 58 |
| (Regular) | 6.67 | 7.29 | 173 | — |
| 409L + | 6.64 | 7.18 | 185 | 72 |
| 0.5% nickel powder (admixed) | 6.62 | 7.17 | 188 | 72 |

TABLE 2(a)-continued

Densities and Transverse Rupture Strengths of Specimens (Comparative Example 2)

| Powder Type | Green Density, gm/cm$^3$ | Sintered Density, gm/cm$^3$ | Transverse Rupture Strength KSI | Hardness HRB |
|---|---|---|---|---|
| 409L + .75% nickel powder (admixed) | 6.65<br>6.64 | 7.21<br>7.23 | 210<br>215 | 81<br>81 |
| 409L + 1.00% nickel (pre-alloyed) | 6.62<br>6.62 | 7.36<br>7.39 | 203<br>212 | 75<br>77 |

TABLE 2(b)

Densities Mechanical Properties of Test Specimens (Comparative Example 2)

| Powder Type | Green Density, gm/cm$^3$ | Sintered Density, gm/cm$^3$ | Yield Strength KSI | Ultimate Tensile Strength KSI | Elong % |
|---|---|---|---|---|---|
| 409L (Regular) | 6.68<br>6.67 | 7.28<br>7.29 | 32<br>33 | 58<br>58 | 32<br>33 |
| 409L + 0.5% nickel powder (admixed) | 6.64<br>6.62 | 7.18<br>7.17 | 43<br>44 | 63<br>63 | 21<br>21 |
| 409L + .75% nickel powder (admixed) | 6.64<br>6.65 | 7.21<br>7.23 | 64<br>67 | 78<br>78 | 10<br>11 |
| 409L + 1.00% nickel (pre-alloy) | 6.62<br>6.62 | 7.39<br>7.40 | 54<br>54 | 75<br>75 | 15<br>15 |

Comparative Example 3

Standard Transverse Rupture Test Specimen and Tensile Test specimens ("dog-bone" shape) were prepared utilizing commercially produced 434L powder (SCM Metal Products Lot 04506524). One set of specimens was made from the as-produced (−100 mesh, water atomized) powder. Two sets of specific were prepared using the above lot of 434L powders admixed with 1.25% and 1.50%, by weight nickel powder, respectively. A fully pre-alloyed 434L powder containing 1.33% nickel was also included in these experiments. All specimens were compacted using standard dies, under a pressure of 40 tons per square inch. Sintering of the three nickel alloyed specimens was carried out in a vacuum furnace at a of 2300° F., using 1000 microns of Hg of argon as the back-fill atmosphere. Sintering time period was 45 minutes. The 434L regular specimens were sintered in a hydrogen atmosphere at 2400° F. for 45 minutes. The mechanical properties of the vacuum and hydrogen sintered specimens would be expected to be quite similar. All sintered specimens were tested using standard Metal Powder Industries Federation (MPIF) procedure. The green densities, sintered densities, and the mechanical properties of all samples are shown in Tables 3(a) and 3(b).

As may be seen in these tables, the yield strength, ultimate tensile strength, the transverse rupture strength and the hardness, increase as the nickel content is increased. The ductility as measured by tensile elongation decreases gradually but is much higher than the minimum required for most common applications. A smaller but still acceptable elongation is observed for the fully pre-alloyed specimens. In most applications, including exhaust flanges, elongations of the order of about 5.0% are sufficient. Hence, one can benefit from nickel addition to increase strength by up to 33% without any significant loss in ductility.

TABLE 3(a)

Densities and Transverse Rupture Strengths of Test Specimens (Comparative Example 3)

| Powder Type | Green Density, gm/cm$^3$ | Sintered Density, gm/cm$^3$ | Transverse Rupture Strength KSI | Hardness HRB |
|---|---|---|---|---|
| 434L (Regular)** | 6.09 | 6.93 | 153 | 58 |
| 434L + 1.25% nickel powder (admixed) | 6.18 | 7.02<br>7.01 | 172<br>170 | 68<br>— |
| 434L + 1.33% nickel (pre-alloyed) | 6.29 | 7.14 | 159 | 68 |
| 434L + 1.50% nickel powder (admixed) | 6.19<br>6.19 | 6.98<br>6.99 | 172<br>173 | 67<br>68 |

**Sintered in hydrogen at 2400° F. for 45 minutes.

TABLE 3(b)

Densities and Mechanical Properties of Tensile Test Specimens (Comparative Example 3)

| Powder Type | Green Density, gm/cm$^3$ | Sintered Density, gm/cm$^3$ | Yield Strength KSI | Ultimate Tensile Strength KSI UTS | Elong % |
|---|---|---|---|---|---|
| 434L (Regular)*** | 6.09<br>6.09 | 6.93<br>6.92 | 36<br>37 | 54<br>53 | 22<br>21 |
| 434L + 1.25% nickel powder (admixed) | 6.18<br>6.17 | 7.02<br>7.01 | 42<br>41 | 57<br>56 | 21<br>19 |
| 434L + 1.33% nickel (pre-alloyed) | 6.29<br>6.29 | 7.14<br>7.14 | 47<br>48 | 63<br>64 | 9<br>10 |
| 434L + 1.50% nickel powder (admixed) | 6.17<br>6.16 | 6.98<br>6.99 | 42<br>42 | 60<br>59 | 14<br>16 |

***Sintered in hydrogen at 2400° F. for 45 minutes.

Comparative Example 4

Standard Transverse Rupture Test Specimens and Tensile Test Specimens ("dog-bone" shape) were prepared utilizing commercially produced 409L powder (SCM Metal Products Lot 04506618). One set of specimens was made from the as-produced (−100 mesh, water atomized) powder. Two sets of specimens were prepared using the above lot of 409L powder admixed with 0.50% and 0.75%, by weight, nickel powder, respectively. A fully pre-alloyed 409L powder containing 1.00% nickel was also included in these experiments. All specimens were compacted using standard dies, under a pressure of 40 tons per square inch. Sintering of all specimens was carried out in a vacuum furnace at a temperature of 2300° F., using 1000 microns of Hg of argon as the back-fill atmosphere. Sintering time period was 45 minutes.

All sintered specimens were tested using standard Metal Powder Industries Federation (MPIF) procedure. The green densities, sintered densities, and the mechanical properties of all samples are shown in Tables 4(a) and 4(b).

As may be seen in these tables, the yield strength, ultimate tensile strength, the transverse rupture strength and the hardness increase, as the nickel content is increased. The ductility as measured by tensile elongation decreases gradually but is much higher than the minimum required for most common applications. A larger but still acceptable elongation is observed for the fully pre-alloyed specimens. In most applications, including exhaust flanges, elongations of the order of about 5.0% are sufficient. Hence, one can benefit from nickel addition to increase strength by up to 33% without any significant loss in ductility.

TABLE 4(a)

Densities and Mechanical Properties of Tensile Test Specimens (Comparative Example 4)

| Powder Type | Green Density, gm/cm$^3$ | Sintered Density, gm/cm$^3$ | Yield Strength KSI | Ultimate Tensile Strength KSI | Elong % |
|---|---|---|---|---|---|
| 409L | 6.45 | 7.14 | 30 | 55 | 32 |
| (Regular) | 6.46 | 7.13 | 30 | 56 | 31 |
| 409L + .50% | 6.39 | 7.10 | 38 | 57 | 19 |
| nickel powder | 6.39 | 7.14 | 39 | 58 | 18 |
| (admixed) | | | | | |
| 409L + .75% | 6.42 | 7.10 | 60 | 72 | 8 |
| nickel powder | 6.41 | 7.04 | 59 | 73 | 9 |
| (admixed) | | | | | |
| 409L + | 6.41 | 7.31 | 49 | 68 | 14 |
| 1.00% nickel | 6.41 | 7.30 | 51 | 70 | 13 |
| powder (pre-alloyed) | | | | | |

TABLE 4(b)

Densities and Transverse Rupture Strengths of Specimens (Comparative Example 4)

| Powder Type | Green Density, gm/cm$^3$ | Sintered Density, gm/cm$^3$ | Transverse Rupture Strength KSI | Hardness HRB |
|---|---|---|---|---|
| 409L (Regular) | 6.45 | 7.15 | 164 | 57 |
| | 6.45 | 7.14 | 165 | 56 |
| 409L + 0.5% | 6.39 | 7.10 | 173 | 66 |
| nickel powder | | | | |
| (admixed) | | | | |
| 409L + .75% | 6.42 | 7.10 | 188 | 78 |
| nickel powder | | 7.04 | 179 | 77 |
| (admixed) | | | | |
| 409L + 1.00% | 6.41 | 7.30 | 185 | 70 |
| nickel (pre- | 6.42 | 7.30 | 188 | 71 |
| alloyed) | | | | |

Comparative Example 5

Standard Transverse Rupture specimen were prepared utilizing commercially produced 409L powder (SCM Metal Products Lot 04506618). One set of specimens were made from the as-produced (−100 mesh, water atomized) powder. Another set of specimen were prepared using the above lot of 409L powder admixed with 1.00%, by weight nickel powder. All specimen were compacted using standard dies, under a pressure of 45 tons per square inch. Sintering of all specimen was carried out in a laboratory tube furnace in an atmosphere of hydrogen. Two samples from each of above two sets were sintered at 2200° F. and two others from each set were sintered at 2320° F. Sintering time period was 45 minutes for both sintering runs. All sintered specimens were tested for transverse rupture strength and hardness using standard Metal Powder Industries Federation (MPIF) procedure. The green densities, sintered densities, the transverse rupture strengths and hardnesses of all samples are shown in Table 5.

As may be seen in this table, the transverse rupture strength and hardness do increase by 15 to 30% when 1.00% nickel addition is made to the 409L alloy powder.

TABLE 5

Densities and Transverse Rupture Strengths of Specimens (Comparative Example 5)

| Powder Type | Sintering**** Temperature (° F.) | Green Density, gm/cm$^3$ | Sintered Density, gm/cm$^3$ | Transverse Rupture Strength, KSI | Hardness, HRB |
|---|---|---|---|---|---|
| 409L (Regular) | 2200° F. | 6.61 | 6.78 | 108 | 34 |
| | | 6.60 | 6.75 | 124 | 35 |
| 409L + 1.00% | 2200° F. | 6.61 | 6.75 | 151 | 61 |
| nickel powder | | 6.62 | 6.75 | 156 | 62 |
| (admixed) | | | | | |
| 409L | 2320° F. | 6.61 | 7.10 | 183 | 58 |
| (Regular) | | 6.62 | 7.11 | 185 | 58 |
| 409L + 1.00% | 2320° F. | 6.60 | 7.01 | 213 | 74 |
| nickel powder | | 6.61 | 7.00 | 207 | 72 |
| (admixed) | | | | | |

****All sintering was carried out in hydrogen atmosphere for 45 minutes.

Upon reading the above application, various alternative constructions and embodiments will become apparent to those skilled in the art. These variations are to be considered within the scope and spirit of the subject invention, which is to be limited only by the following claims and their equivalents.

What is claimed is:

1. A ferritic stainless steel powder comprising water atomized stainless steel pre-alloyed powder containing nickel in an amount effective to increase tensile strength of products sintered from said powder.

2. The ferritic stainless steel powder of claim 1, wherein said pre-alloyed powder contains from about 0.3 to 3.0 weight percent nickel.

3. A sintered product composed of the ferritic stainless steel powder of claim 1.

4. A ferritic stainless steel powder comprising (a) water atomized stainless steel pre-alloyed powder containing nickel and (b) nickel or nickel bearing additive or both in particulate form, wherein the total amount of said nickel in said pre-alloy powdered and in said particulate form is an amount effective to increase tensile strength of products sintered from said powder.

5. The ferritic stainless steel powder of claim 4, wherein said total amount of nickel is from about 0.3 to 3.0 weight percent.

6. The ferritic stainless steel powder of claim 4, wherein said nickel in particulate form is a nickel bearing additive.

7. A sintered product composed of the ferritic stainless steel powder of claim 4.

8. A ferritic stainless steel powder comprising (a) water atomized stainless steel pre-alloyed powder and (b) nickel or nickel bearing additive or both in particulate form, wherein the total amount of nickel is an amount effective to increase tensile strength of products sintered from said powder.

9. The ferritic stainless steel powder of claim 8, wherein said total amount of nickel is from about 0.3 to 3.0 weight percent.

10. The ferritic stainless steel powder of claim 8, wherein said nickel in particulate form is a nickel bearing additive.

11. A sintered product composed of the ferritic stainless steel powder of claim 8.

12. A method of forming a sintered, ferritic stainless steel product by a rigid die powder metallurgical technique comprising (a) forming into a desired shape in a rigid die a ferritic stainless steel powder containing nickel in an amount effective to increase the tensile strength of products formed by said method, and (b) heating said formed powder at a sintering temperature for a period of time sufficient to form a solid sintered product.

13. The method of claim 12, wherein said ferritic stainless steel powder contains from about 0.3 to about 3.0 weight percent nickel.

* * * * *